US012584717B2

(12) United States Patent
Izuma

(10) Patent No.: US 12,584,717 B2
(45) Date of Patent: Mar. 24, 2026

(54) GAS GENERATOR

(71) Applicant: DAICEL CORPORATION, Osaka (JP)

(72) Inventor: Toshihiro Izuma, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 0 days.

(21) Appl. No.: 18/954,939

(22) Filed: Nov. 21, 2024

(65) Prior Publication Data

US 2025/0085091 A1 Mar. 13, 2025

Related U.S. Application Data

(63) Continuation of application No. PCT/JP2023/017062, filed on May 1, 2023.

(30) Foreign Application Priority Data

May 31, 2022 (JP) ..... 2022-088770

(51) Int. Cl.
*F42B 3/04* (2006.01)

(52) U.S. Cl.
CPC ..... *F42B 3/04* (2013.01)

(58) Field of Classification Search
CPC ..... F42B 3/04
USPC ..... 102/530–531; 280/741
See application file for complete search history.

(56) References Cited

U.S. PATENT DOCUMENTS 5,492,364 A * 2/1996 Anderson ..... B60R 21/2644 280/736
5,700,030 A 12/1997 Goetz
6,007,098 A * 12/1999 Olson ..... B60R 21/2644 280/236
6,682,708 B1 * 1/2004 Zeuner ..... C06D 5/00 422/305

(Continued)

FOREIGN PATENT DOCUMENTS

WO WO-0110686 A1 * 2/2001 ..... C06D 5/06

OTHER PUBLICATIONS

International Search Report issued in International Application No. PCT/JP2023/017062 on Jul. 18, 2023, with English translation.

(Continued)

*Primary Examiner* — Reginald S Tillman, Jr.
(74) *Attorney, Agent, or Firm* — Birch, Stewart, Kolasch & Birch, LLP

(57) ABSTRACT

A gas generator includes: a housing; an ignition unit disposed in the housing; a gas generating agent accommodated in a combustion chamber in the housing and that generates a combustion gas upon operation of the ignition unit; a discharge port provided in the housing and configured to discharge the generated combustion gas; and a filter disposed between the discharge port and the gas generating agent. The filter extends in an axial direction, at least an outer peripheral portion on one end surface of the filter in the axial direction is connected to an inner wall surface of the housing to surround the discharge port, a portion that is at least a part of an outer peripheral surface of the filter around an axis and extends over the entire circumference is an inflow portion of the combustion gas, and the inflow portion is in communication with the combustion chamber.

14 Claims, 13 Drawing Sheets

(56) References Cited

U.S. PATENT DOCUMENTS

| | | | | |
|---|---|---|---|---|
| 6,966,578 | B2 * | 11/2005 | Smith | B60R 21/2644 280/736 |
| 7,806,436 | B2 * | 10/2010 | Stevens | B60R 21/272 280/736 |
| 8,979,121 | B2 * | 3/2015 | Smith | B60R 21/2644 280/736 |
| 9,102,303 | B2 * | 8/2015 | Tokuda | B60R 21/272 |
| 2014/0305330 | A1 * | 10/2014 | Stevens | B60R 21/272 102/530 |
| 2019/0001917 | A1 | 1/2019 | Prima et al. | |

OTHER PUBLICATIONS

Written Opinion of the International Searching Authority issued in International Application No. PCT/JP2023/017062 on Jul. 18, 2023, with English translation.

* cited by examiner

GAS GENERATOR

CROSS REFERENCE TO RELATED APPLICATIONS

This application is a Continuation of PCT International Application No. PCT/JP2023/017062, filed on May 1, 2023, which claims priority under 35 U.S.C. 119(a) to Patent Application No. 2022-088770, filed in Japan on May 31, 2022, all of which are hereby expressly incorporated by reference into the present application.

TECHNICAL FIELD

The present invention relates to a gas generator.

BACKGROUND ART

A known widely used gas generator fills a gas generating agent in a combustion chamber formed in a housing, burns the gas generating agent by an igniter to generate combustion gas, and discharges the combustion gas to the exterior from a gas discharge port provided in the housing. To cool the generated combustion gas and trap residues in such a gas generator, a tubular filter may be disposed between the combustion chamber and the gas discharge port.

Patent Document 1 discloses a gas generator including an ignitable material arranged to produce gas, a sub-assembly formed of a first component and a second component that are fixed by friction welding, a third component fixed to the first component or the second component by friction welding, and a tubular filter.

CITATION LIST

Patent Document

Patent Document 1: US 2019/001917 A

SUMMARY

The aforementioned gas generator is configured such that combustion gas flows from the inside to the outside of a cylindrical filter. Since combustion residues are filtered out when the combustion gas passes through the filter, the amount of combustion residues contained in the combustion gas (hereinafter, also referred to as a contained residue amount) is large on the inflow side of the filter, and the contained residue amount is small on the outflow side of the filter. Therefore, in a configuration where the combustion gas flows from the inner peripheral surface to the outer peripheral surface of the cylindrical filter, the contained residue amount when the combustion gas flows into the inner peripheral surface narrower than the outer peripheral surface is large, and the contained residue amount when the combustion gas passes through the relatively wide outer peripheral surface is small. As a result, the filter cannot be efficiently used, and a technique for improving the use efficiency of the filter is required.

The technique according to the present disclosure has been made in view of the above circumstances, and an object thereof is to provide a technique that improves the use efficiency of a filter in a gas generator.

To solve the above problem, the technique of the present disclosure adopts the following configuration. In other words, a gas generator according to an aspect of the present disclosure includes: a housing; an ignition unit disposed in the housing; a gas generating agent that is accommodated in a combustion chamber in the housing and that generates a combustion gas upon operation of the ignition unit; a discharge port provided in the housing and configured to discharge the combustion gas generated in the housing to an outside; and a filter disposed between the discharge port and the gas generating agent. The filter extends in an axial direction, at least an outer peripheral portion on one end surface of the filter in the axial direction is connected to an inner wall surface of the housing to surround the discharge port, a portion that is at least a part of an outer peripheral surface of the filter around an axis and extends over the entire circumference is an inflow portion of the combustion gas, and the inflow portion is disposed to be in communication with the combustion chamber.

The gas generator according to an aspect of the present disclosure may further include a partition wall member partitioning the housing into the combustion chamber in which the gas generating agent is accommodated and a filter chamber in which the filter is disposed, the partition wall member being provided with, in a part of the partition wall member, a communication hole configured to allow the combustion chamber and the filter chamber to be in communication with each other. A second end surface opposite to a first end surface connected to the inner wall surface of the housing in the axial direction of the filter may be connected to the partition wall member.

In the gas generator according to an aspect of the present disclosure, the housing may include a tubular peripheral wall portion extending along the axial direction, a first wall portion closing one end of the tubular peripheral wall portion, and a second wall portion closing the other end of the tubular peripheral wall portion. The communication hole may be formed in the first wall portion in a direction in which the combustion gas is released in a direction orthogonal to the first wall portion.

In the gas generator according to an aspect of the present disclosure, the housing may include a tubular peripheral wall portion extending along the axial direction, a first wall portion in which the discharge port is formed and which closes one end of the tubular peripheral wall portion, and a second wall portion closing the other end of the tubular peripheral wall portion. A groove portion may be disposed in an inner surface of the first wall portion along a circumferential direction, and the communication hole may be disposed at a position in which the combustion gas is released toward the groove portion.

In the gas generator according to an aspect of the present disclosure, the housing may include a tubular peripheral wall portion extending along the axial direction, a first wall portion in which the discharge port is formed and which closes one end of the tubular peripheral wall portion, and a second wall portion closing the other end of the tubular peripheral wall portion. The partition wall member may be formed such that a portion not connected to the filter protrudes toward the first wall portion of the housing with respect to a portion connected to the filter.

In the gas generator according to an aspect of the present disclosure, the housing may include a peripheral wall portion having a tubular shape. The communication hole may be formed in a direction in which the combustion gas is released toward the peripheral wall portion.

In the gas generator according to an aspect of the present disclosure, the filter may be formed in a cylindrical shape.

In the gas generator according to an aspect of the present disclosure, the housing may include a tubular peripheral wall portion extending along the axial direction, a first wall portion closing one end of the tubular peripheral wall portion, and a second wall portion closing the other end of the tubular peripheral wall portion. One end surface of the filter in the axial direction may be connected to the first wall portion, and the other end surface of the filter may be connected to the second wall portion.

Advantageous Effects

According to the present disclosure, a gas generator including a filter can provide improved use efficiency of the filter.

DESCRIPTION OF EMBODIMENTS

A gas generator according to an embodiment of the present disclosure will be described below with reference to the drawings. It should be noted that the respective configurations and the combinations thereof in the respective embodiments are merely examples, and additions, omissions, substitutions, and other changes to the configurations can be made as appropriate without departing from the gist of the present invention. The present invention is not limited by the embodiments and is limited only by the claims.

First Embodiment

Figure 1:
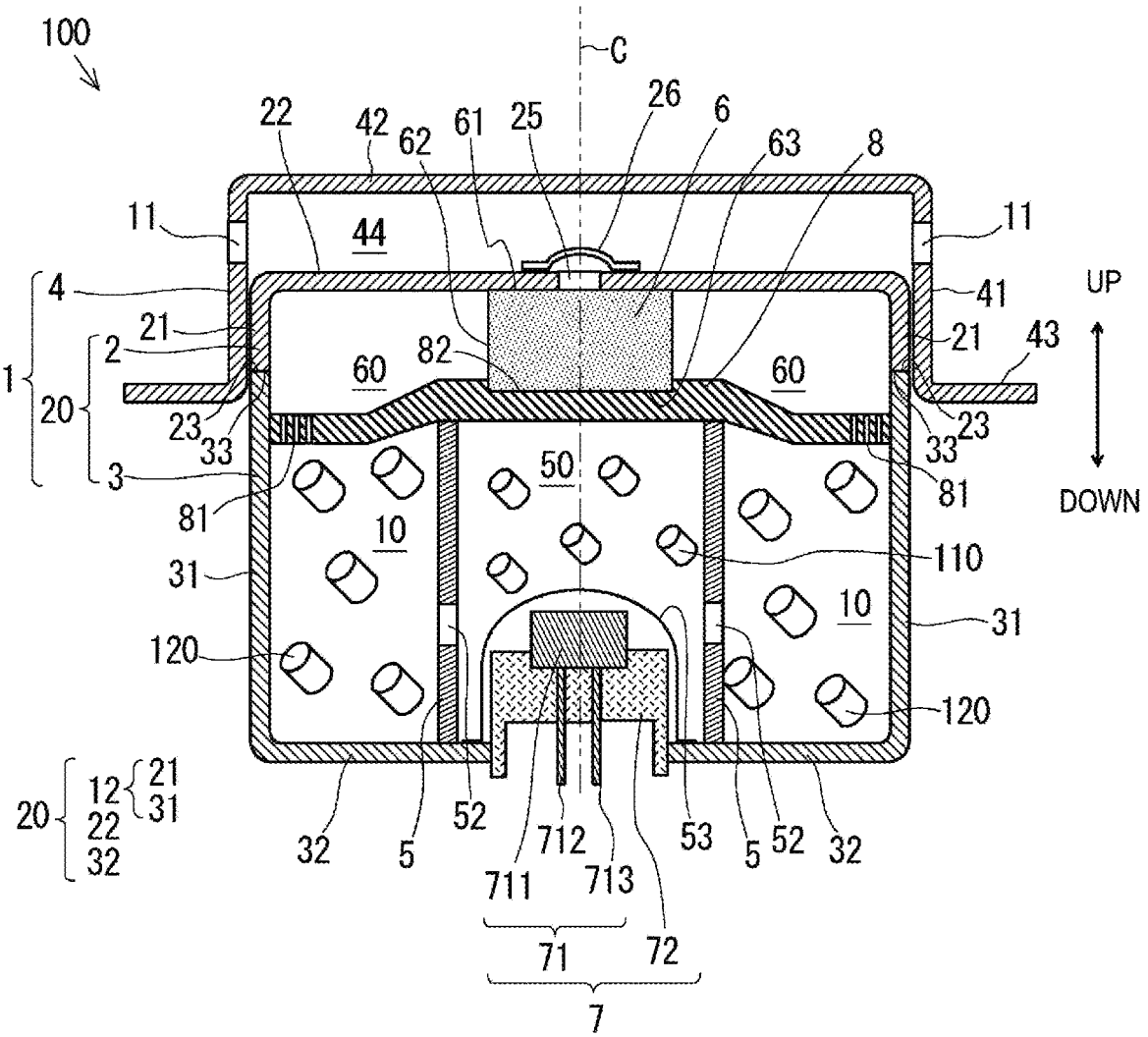
FIG. 1 is an axial cross-sectional view schematically illustrating an internal structure along the center axis of a gas generator according to a first embodiment.

FIG. 1 is an axial cross-sectional view schematically illustrating an internal structure along a center axis C of a gas generator 100 according to a first embodiment. Hereinafter, as illustrated in FIG. 1, a cross section obtained by cutting the gas generator 100 along the center axis C may be referred to as a "vertical cross-section" of the gas generator 100. The direction along the center axis C of the gas generator 100 may be referred to as an "up-down direction" or an "axial direction" of the gas generator 100, and one side (an upper side in FIG. 1) and the other side (an lower side in FIG. 1) in the up-down or axial direction may be referred to as "upper side" and "down side", respectively. These directions are examples for describing the present embodiment, and the arrangement or the like of the gas generator 100 is not limited thereto. FIG. 1 illustrates a state of the gas generator 100 before activation. The gas generator 100 is, for example, a gas generator for an airbag, which is configured to supply the airbag with gas for inflating and deploying the airbag.

Overall Configuration

As illustrated in FIG. 1, the gas generator 100 includes an ignition device 7, an inner tubular member 5, a filter 6, a partition wall member 8, a transfer charge 110, a gas generating agent 120, and a housing 1 that accommodates these elements. The gas generator 100 of the present embodiment is configured as a so-called single-type gas generator including only one ignition device. The gas generator 100 is not limited thereto and may be configured to include a plurality of ignition devices. The gas generator 100 is configured to burn the gas generating agent 120 by activating an igniter 71 included in the ignition device 7 and discharge combustion gas, which is a combustion product, from a gas discharge port 11 formed in the housing 1. Hereinafter, each configuration of the gas generator 100 will be described.

Housing

The housing 1 is a member that accommodates the inner tubular member 5, the filter 6, the ignition device 7, the partition wall member 8, the transfer charge 110, and the gas generating agent 120. The housing 1 is provided with an upper container 2 and a lower container 3 made of a metal each formed in a bottomed substantially tubular shape, and is formed in a short tubular shape in which both axial ends are closed by joining the upper container 2 and the lower container 3 in a state where opening ends face each other. The upper container 2 and the lower container 3 define a combustion chamber 10, and constitute a container 20 in which the gas generating agent 120 and the like are disposed. The housing 1 also includes an outer shell member 4 externally fitted to the gas discharge side of the container 20, that is, the upper side in the present example.

The upper container 2 includes an upper peripheral wall portion 21 that has a tubular shape and a top plate portion 22 that closes an upper end of the upper peripheral wall portion 21, thereby forming an internal space. An opening of the upper container 2 is formed on the lower end side of the internal space. The lower container 3 includes a lower peripheral wall portion 31 that has a tubular shape and a bottom plate portion 32 that closes a lower end of the lower peripheral wall portion 31 and to which the ignition device 7 is fixed, thereby forming an internal space. An opening of the lower container 3 is formed in an upper end portion of the internal space.

A joining portion 23 as an opening side end portion of the upper container 2 and a joining portion 33 as an opening side end portion of the lower container 3 are overlapped and joined by laser welding or the like to form the container 20 having a short cylindrical shape with both axial ends closed. The upper peripheral wall portion 21 of the upper container 2 and the lower peripheral wall portion 31 of the lower container 3 form a peripheral wall portion 12 of the container 20. In other words, the container 20 includes the peripheral wall portion 12 having a tubular shape, the top plate portion 22 disposed on one end side of the peripheral wall portion 12, and the bottom plate portion 32 disposed on the other end side of the peripheral wall portion 12. The top plate portion 22 corresponds to a "first wall portion" according to the present disclosure. The bottom plate portion 32 corresponds to a "second wall portion" according to the present disclosure.

The top plate portion 22 of the container 20 is provided with a discharge port 25 extending through the container 20 from the inside to the outside and configured to discharge the combustion gas generated in the container 20 to the outside. The position of the discharge port 25 is not particularly limited, but in the present embodiment, the discharge port 25 is disposed at the center of the top plate portion 22 in a plan view. In other words, the discharge port 25 is formed concentrically with the peripheral wall portion 12.

The ignition device 7 and the inner tubular member 5 are disposed in the lower container 3, and a lower end of the inner tubular member 5 is joined to the bottom plate portion 32 of the lower container 3. The inner tubular member 5 is a tubular member extending from the bottom plate portion 32 toward the top plate portion 22 to surround the ignition device 7.

The inner tubular member 5 is disposed concentrically with the peripheral wall portion 12, and an inner space thereof serves as a fire transfer chamber 50 and an outer space thereof serves as the combustion chamber 10. The partition wall member 8 formed in a substantially disc-like shape is disposed on the upper side of the inner tubular member 5 to define upper surfaces of the fire transfer chamber 50 and the combustion chamber 10. The partition wall member 8 defines the combustion chamber 10 and the fire transfer chamber 50 on the lower side and a filter chamber 60 on the upper side in the container 20. A plurality of communication holes 81 for enabling the combustion chamber 10 and the filter chamber 60 to be in communication with each other are disposed in the partition wall member 8 at a location near the outer edge thereof. The number and arrangement of the communication holes 81 are not particularly limited, but in the present embodiment, the plurality of communication holes 81 are disposed in the radial direction of the partition wall member 8, and the plurality of communication holes 81 are disposed at equal intervals along the circumferential direction of the partition wall member 8. Each of the communication holes 81 is formed along the axial direction of the housing 1 and is formed in a direction in which the combustion gas is released in a direction orthogonal to the direction in which the top plate portion 22 extends. In other words, the communication hole 81 of the present embodiment is formed in a direction along the center axis C. Also, in a case where the top plate portion 22 has a spherical shape, the discharge direction of the combustion gas may be a direction along the center axis C or may be a direction (radial direction) perpendicular to a tangential line on the spherical surface.

The ignition device 7 is disposed in the fire transfer chamber 50 inside the inner tubular member 5, and the transfer charge 110 is made to fill the space around the ignition device 7. Further, the combustion chamber 10 outside the inner tubular member 5 is filled with the gas generating agent 120. A plurality of communication holes 52 for enabling the fire transfer chamber 50 as the internal space to be in communication with the combustion chamber 10 as the external space are formed in the inner tubular member 5 along the circumferential direction. Each of the communication holes 52 is closed by a seal tape (not illustrated) in a state before the ignition device 7 is activated. When the ignition device 7 is activated, the seal tape is raptured by the pressure of the combustion gas, and the fire transfer chamber 50 and the combustion chamber 10 are in communication with each other. Note that the communication hole 52 only needs to enable the interior and the exterior of the fire transfer chamber 50 to be in communication with each other when at least the ignition device 7 is activated and does not need to be closed with a seal tape.

The filter 6 is disposed in the filter chamber 60 in the container 20. The shape of the filter 6 is not particularly limited, and may be, for example, tubular or columnar. Note that the filter 6 of the present embodiment has a columnar shape. In addition, although the filter 6 of the present embodiment is disposed at the center of the filter chamber 60 to cover the discharge port 25, the configuration is not limited thereto. The filter 6 may be disposed at a position between the discharge port 25 and the gas generating agent 120 through which the combustion gas passes. In other words, the discharge port 25 is formed within a projection region of a cross-sectional shape of the filter 6 orthogonal to the center axis C.

The filter 6 has an upper surface 61 in contact with the top plate portion 22 of the container 20 and a lower surface 63 in contact with an upper surface of the partition wall member 8, and the filter 6 is sandwiched between the top plate portion 22 and the partition wall member 8. A recessed portion 82 having substantially the same shape as the lower portion of the filter 6 is disposed on the upper surface of the partition wall member 8, and the lower portion of the filter 6 is fitted into the recessed portion 82 and thereby is positioned.

The container 20 is filled with a pressurized inert gas (hereinafter, also referred to as pressurized gas), and the discharge port 25 is closed by a rupturable plate 26. A seal member 53 having a cup shape is disposed to cover the space around the ignition device 7, and thus airtightness in an opening portion of the bottom plate portion 32 to which the ignition device 7 is attached is maintained. The seal member 53 is made of, for example, a metal and is joined to the bottom plate portion 32 by welding or the like. The seal member 53 has rigidity that can withstand the pressure of the inert gas, and is configured to rupture by operation of the ignition device 7. Here, examples of the inert gas include argon, helium, and a mixture thereof. The gas generator 100 of the present embodiment is a hybrid gas generator configured to discharge pressurized gas and combustion gas during operation.

The outer shell member 4 attached on the gas discharge side of the container 20 includes a peripheral wall portion 41 having a tubular shape, a top plate portion 42 closing an upper end of the peripheral wall portion 41, and a flange portion 43 extended in the radial direction from a lower end of the peripheral wall portion 41. The outer shell member 4 is externally fitted to an upper portion of the container 20 and is joined to an outer surface of the peripheral wall portion 12. In a state where the outer shell member 4 is joined to the container 20 as just described, the outer shell member 4 forms a discharge side space 44 serving as a discharge path of the combustion gas between the outer shell member 4 and the top plate portion 22 of the container 20. In the peripheral wall portion 41 of the outer shell member 4, a plurality of gas discharge ports 11 enabling the discharge side space 44 and the external space to be in communication with each other are formed side by side along the circumferential direction.

Ignition Device

As illustrated in FIG. 1, the ignition device 7 includes the igniter 71 and an attachment member 72, and is fixed to the bottom plate portion 32 of the lower container 3. The ignition device 7 corresponds to an "ignition unit" according to the present disclosure. The igniter 71 includes a cup body 711 made of a metal and accommodating an ignition charge, and a pair of energizing pins 712 and 713 for receiving supply of a current from the outside. The igniter 71 is activated by the ignition current supplied to the pair of energizing pins 712 and 713 to burn the ignition charge, and discharges the combustion product to the outside of the cup body 711.

The attachment member 72 is a member that is interposed between the igniter 71 and the bottom plate portion 32 to fix the igniter 71 to the bottom plate portion 32. The attachment member 72 includes resin that covers a lower portion of the igniter 71, and forms a connector insertion space into which a connector (not illustrated) for supplying power from an external power supply to the pair of energizing pins 712 and 713 can be inserted. Note that fixing of the igniter 71 to the bottom plate portion 32 and the relationship between the attachment member 72 and the bottom plate portion 32 are not limited to those of FIG. 1, and a known technique can be used.

Filter

Figure 2:
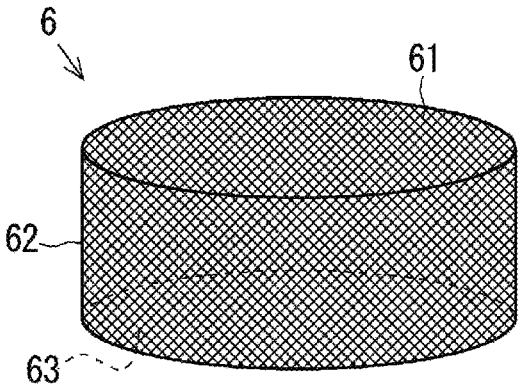
FIG. 2 is a diagram illustrating the configuration of a filter.

FIG. 2 is a drawing illustrating the configuration of the filter 6. The filter 6 is a tubular member formed of a metal material, and is a member having fine holes that have functions of filtering residues in the combustion gas and cooling the combustion gas by allowing the combustion gas to pass therethrough. The filter 6 extends in the axial direction, and at least an outer peripheral portion of a first end surface (the upper surface) 61 in the axial direction is connected to the top plate portion 22 to surround the discharge port 25. At least a portion of an outer peripheral surface 62 that exists around the axis and extends over the entire circumference is an inflow portion of the combustion gas, and the inflow portion is disposed to be in communication with the combustion chamber 10 during operation. Thus, when the combustion gas is released from the combustion chamber 10 during operation, the combustion gas flows in from the outer peripheral surface 62 of the filter 6 and is released from the center of the upper surface 61 to the discharge port 25. At this time, since the upper surface 61 of the filter 6 is in contact with the top plate portion 22 and the lower surface (a second end surface) 63 on the opposite side is in contact with the recessed portion 82 of the partition wall member 8, the combustion gas is prevented from flowing between the upper surface 61 and the top plate portion 22 or between the lower surface 63 and the partition wall member 8, that is, a so-called "short path" is prevented. Note that sealing means may be disposed between the upper surface 61 and the top plate portion 22 or between the lower surface 63 and the partition wall member 8, or both.

The filter 6 according to the present example is formed by radially stacking annular metal plates in which multiple holes are formed. For example, the filter 6 may be formed by concentrically stacking tubular metal plates or by spirally winding a metal plate in a plan view so as to be stacked in the radial direction. Alternatively, the filter 6 may be formed by stacking disc-shaped porous metal plates in the axial direction. Examples of the porous metal plate serving as a material of the filter 6 include expanded metal, lath metal, perforated metal, and wire. Note that in FIG. 2, reference sign 62 denotes the outer peripheral surface of the filter 6. Since a plurality of holes are formed in the filter 6, the combustion gas of the gas generating agent 120 disposed in the combustion chamber 10 can pass through the filter 6. The filter 6 filters the combustion gas by collecting combustion residues contained in the combustion gas. In addition to the aforementioned function of filtering the combustion gas, the filter 6 also has a function of cooling the combustion gas by removing heat of the combustion gas when the combustion gas passes through the filter 6. Moreover, the filter 6 may be a compression-molded filter as disclosed in JP 10-119705 A or a winding filter in which metal wire is wound in multiple layers as disclosed in JP 2005-193138 A.

Figure 3:
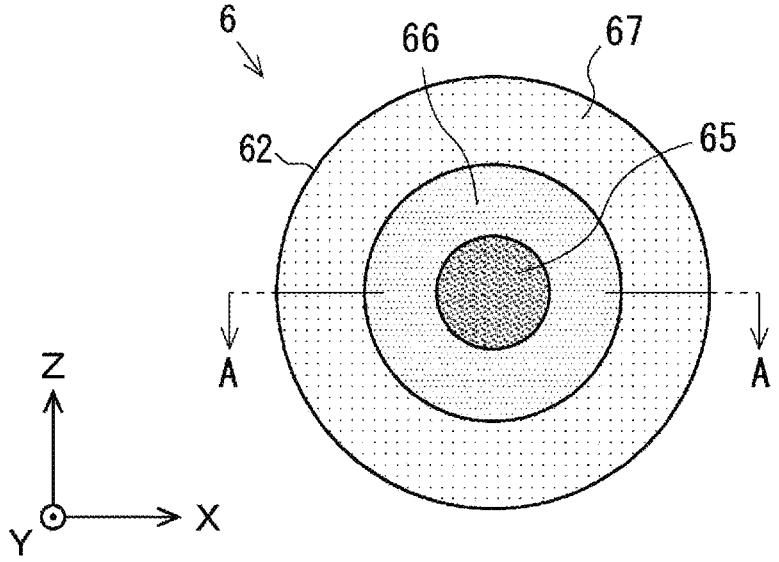
FIG. 3 is a plan view illustrating an example of a layer structure in the filter.
Figure 4:
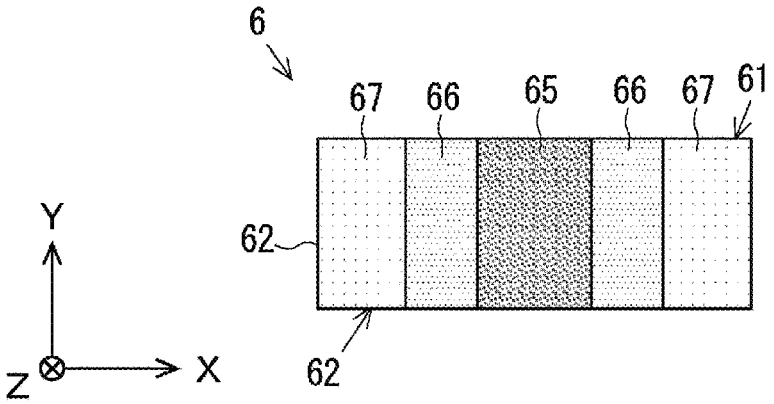
FIG. 4 is a cross-sectional view taken along line A-A of FIG. 3.

FIG. 3 is a plan view illustrating an example of a layer structure in the filter 6, and FIG. 4 is a cross-sectional view taken along line A-A in FIG. 3. The filter 6 may include a plurality of layers in the radial direction, and the layers may be configured to have different specifications. For example, the filter 6 may be configured such that the density of the inner layer is higher (the aperture ratio is smaller) than that of the outer layer. The filter 6 of FIGS. 3 and 4 includes three layers of an inner portion 65, an intermediate portion 66, and an outer portion 67. The density of the intermediate portion 66 is lower than that of the inner portion 65, and the density of the outer portion 67 is lower than that of the intermediate portion 66.

Transfer Charge

In addition to a known black powder, a gas generating agent having good ignition quality and a higher combustion temperature than the gas generating agent 120 can be used as the transfer charge 110. The combustion temperature of the transfer charge 110 can be set in a range of 1700° C. to 3000° C. As the transfer charge 110, a known transfer charge containing, for example, nitroguanidine (34 wt. %) and strontium nitrate (56 wt. %) can be used. In addition, various shapes, such as a granular shape, a pellet shape, a columnar shape, and a disc shape, can be adopted for the transfer charge 110.

Gas Generating Agent

As the gas generating agent 120, a gas generating agent having a relatively low combustion temperature can be used. The combustion temperature of the gas generating agent 120 can be set in the range of 1000° C. to 1700° C. As the gas generating agent 120, a known agent including, for example, guanidine nitrate (41 wt %), basic copper nitrate (49 wt %), a binder, and an additive can be used. The gas generating agent 120 may have any of a variety of shapes, such as a granular shape, a pellet shape, a columnar shape, or a disc shape.

Operation

The operation of the gas generator 100 according to the first embodiment will be described below. First, description will be made with reference to FIG. 1. When a sensor (not illustrated) senses an impact, an ignition current is supplied to the pair of energizing pins 712 and 713 and the igniter 71 is activated. In other words, the ignition charge accommodated in the cup body 711 of the igniter 71 burns, and a flame, a high-temperature gas, and the like, which are combustion products, burst the cup body 711 and are released to the outside of the cup body 711. Thus, the transfer charge 110 accommodated in the fire transfer chamber 50 burns, and a combustion gas is generated. The combustion gas of the transfer charge 110 breaks the seal tape closing the communication hole 52 and is released from the communication hole 52 to the outside of the fire transfer chamber 50. Then, the combustion gas of the transfer charge 110 comes into contact with the gas generating agent 120, and the gas generating agent 120 is ignited. The combustion of the gas generating agent 120 generates high-temperature and high-pressure combustion gas in the combustion chamber 10. When the generation of the combustion gas is started and the pressure in the container 20 is increased in this way, the rupturable plate 26 closing the discharge port 25 ruptures, and the combustion gas is discharged from the discharge port 25 together with the pressurized gas in the container 20. At this time, the combustion gas passes through the filter 6, and thus the combustion gas is cooled, and combustion residues are trapped. The pressurized gas and the combustion gas that have passed through the filter 6 to be discharged from the discharge port 25 to the discharge side space 44 hit the top plate portion 42 of the outer shell member 4, are deflected in the radial direction of the housing 1, and are released from the gas discharge port 11 to the outside of the housing 1. The pressurized gas and the combustion gas are released to the outside of the housing 1 and thereafter flow into an airbag (not illustrated). This causes the airbag to inflate, and thus a cushion is formed between an occupant and a rigid structure, and the occupant is protected from an impact.

Actions and Effects

In the gas generator 100 of the present embodiment, at least the outer peripheral portion of the one end surface 61 of the filter 6 is connected to an inner wall surface of the top plate portion 22 to surround the discharge port 25, and the outer peripheral surface 62 is disposed to be in communication with the combustion chamber 10. As a result, the combustion gas passes through the outer peripheral surface 62 of the filter 6 at the initial stage of inflow when the amount of combustion residues contained therein (hereinafter, also referred to as a contained residue amount) is large, and passes through the inner portion while being filtered with the contained residue amount decreasing. In other words, as the combustion gas passes inward from the inflow portion formed entirely in the circumferential direction of the outer peripheral surface 62 of the filter 6, the contained residue amount decreases due to filtration, and the combustion gas temperature also decreases. In addition, the cross-sectional area in the filter radial direction with which the combustion gas comes into contact also gradually decreases. In other words, a contact area of the filter corresponding to the contained residue amount and the gas temperature is provided. Therefore, the use efficiency of the filter 6 can be improved, and the performance of the gas generator 100 can be improved. Further, by improving the use efficiency of the filter 6, the same filter performance as that of a known filter can be achieved by the small filter 6, and thus the gas generator 100 can be reduced in size.

Furthermore, in the gas generator 100 of the present embodiment, the filter 6 may include a plurality of layers in the radial direction, and the density of the inner layers may be higher than that of the outer layers. As a result, the use efficiency of the filter 6 can be further improved.

Further, in the gas generator 100 of the present embodiment, the communication hole 81 of the partition wall member 8 is formed in a direction in which the combustion gas is released in a direction orthogonal to the extension direction of the top plate portion 22. Thus, the combustion gas generated in the combustion chamber 10 is first brought into contact with the top plate portion 22 to allow large residues and highly adhesive residues to adhere to the top plate portion 22, and then the combustion gas flows into the filter 6. As a result, the use efficiency of the filter 6 is further improved.

Furthermore, in the gas generator 100 of the present embodiment, the upper surface 61 of the filter 6 is disposed in contact with the top plate portion 22, and the lower surface 63 of the filter 6 is disposed in contact with the recessed portion 82 of the partition wall member 8. As a result, the combustion gas is prevented from flowing between the upper surface 61 and the top plate portion 22 or between the lower surface 63 and the partition wall member 8, that is, a so-called "short path" is prevented, and the use efficiency of the filter 6 can be improved. Note that in the first embodiment, a gap may be formed between the lower surface 63 and the partition wall member 8 as long as a short path between the upper surface 61 of the filter 6 and the top plate portion 22 is prevented.

Second Embodiment

Figure 5:
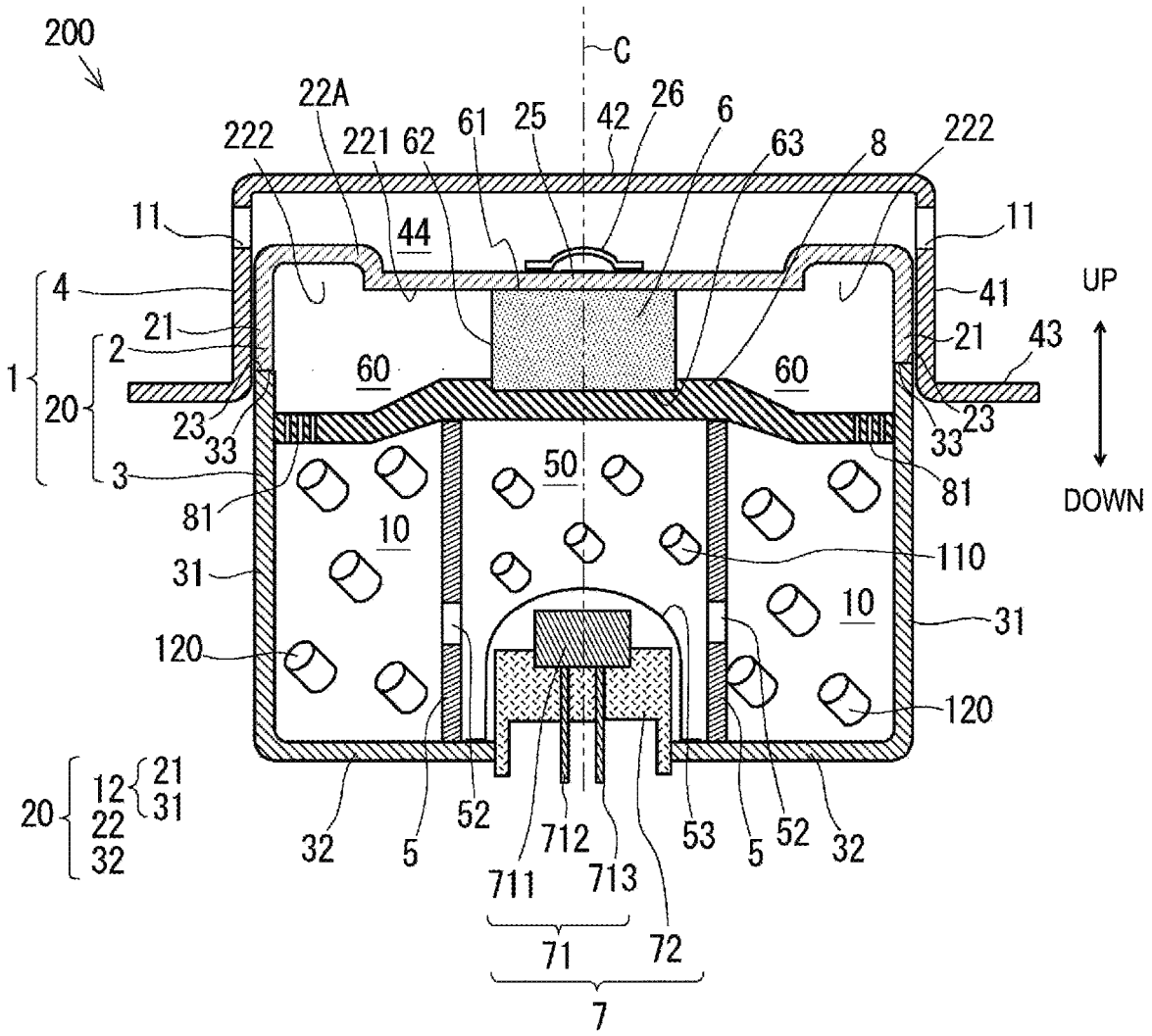
FIG. 5 is an axial cross-sectional view of a gas generator according to a second embodiment.
Figure 6:
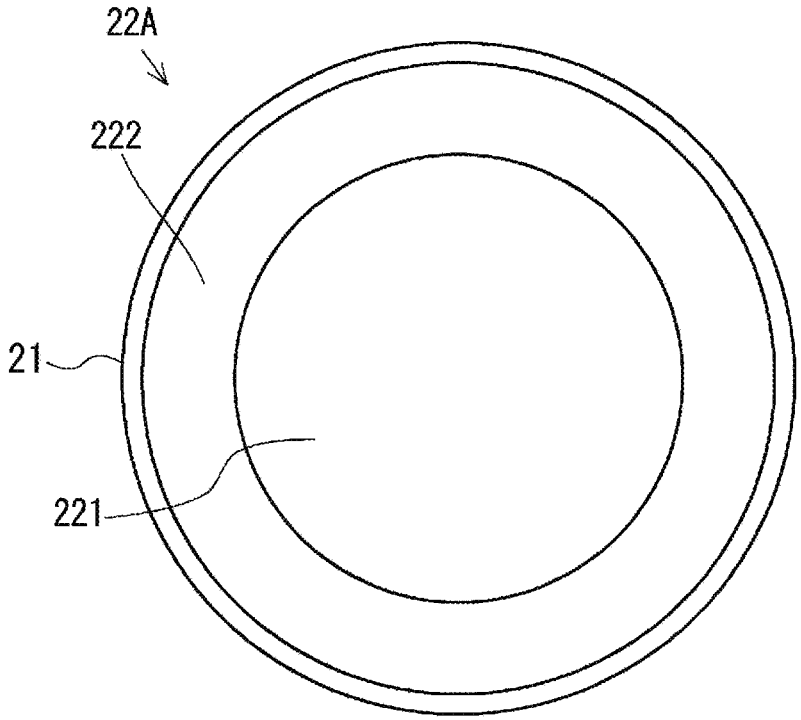
FIG. 6 is a diagram illustrating a lower surface of a partition wall member.

FIG. 5 is an axial cross-sectional view of a gas generator 200 according to a second embodiment. FIG. 6 is a diagram illustrating a lower surface of the partition wall member 8. FIG. 5 illustrates a state of the gas generator 200 before activation. The present embodiment is different from the aforementioned first embodiment in terms of the configuration of a top plate portion 22A, but the other configurations are the same as those of the first embodiment. Accordingly, the same elements as those of the first embodiment are denoted by the same reference signs or the like and description thereof will not be repeated.

As illustrated in FIGS. 5 and 6, the upper container 2 of the present embodiment includes the upper peripheral wall portion 21 that has a tubular shape and the top plate portion 22A that closes the upper end of the upper peripheral wall portion 21, and a groove portion 222 along the circumferential direction is disposed on a lower surface 221 side of the top plate portion 22A. In addition, the communication hole 81 of the partition wall member 8 is disposed at a position in which the combustion gas is released toward the groove portion 222. The communication hole 81 of the present embodiment is formed in the axial direction immediately below the groove portion 222, and discharges the combustion gas toward the groove portion 222.

As described above, according to the present embodiment, the combustion gas generated in the combustion chamber 10 is discharged toward the groove portion 222, and remains in the groove portion 222 and thereafter flows into the filter 6. Therefore, large residues or highly adhesive residues in the combustion gas are removed by the groove portion 222, and the use efficiency of the filter 6 can be improved. Recesses and protrusions may be further disposed on the surface of the groove portion 222 to increase the contact area with the combustion gas.

Third Embodiment

Figure 7:
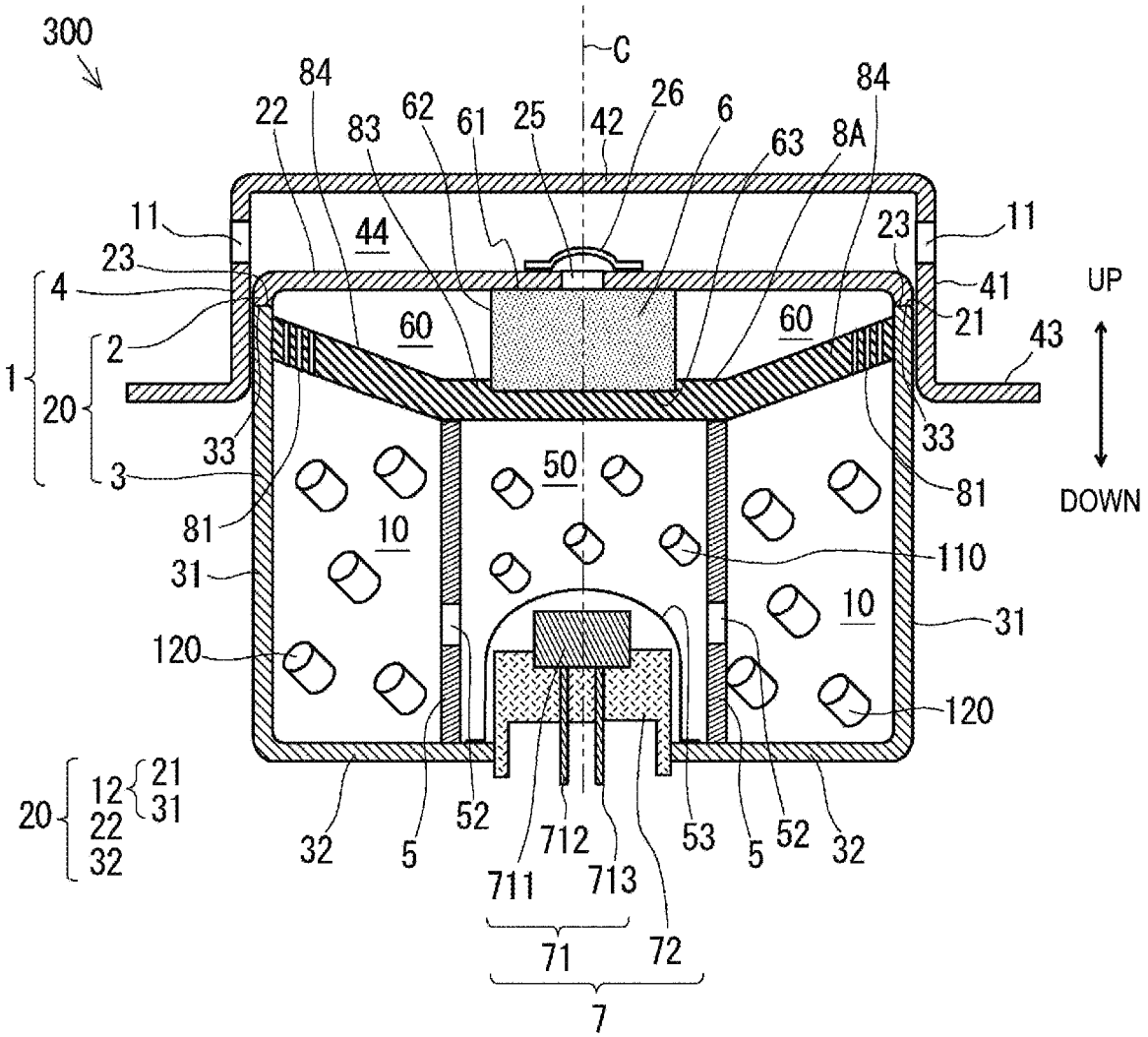
FIG. 7 is an axial cross-sectional view of a gas generator according to a third embodiment.

FIG. 7 is an axial cross-sectional view of a gas generator 300 according to a third embodiment. FIG. 7 illustrates a state of the gas generator 300 before activation. The present embodiment is different from the aforementioned first embodiment in terms of the configuration of a partition wall member 8A, but the other configurations are the same as those of the first embodiment. Accordingly, the same elements as those of the first embodiment are denoted by the same reference signs or the like and description thereof will not be repeated.

As illustrated in FIG. 7, the partition wall member 8A of the present embodiment is formed such that an outer portion 84 not connected to the filter 6 protrudes toward the top plate portion 22 of the housing 1 with respect to a center portion 83 connected to the filter 6. In the example in FIG. 7, the outer portion 84 is formed in a tapered shape to be positioned on the upper side as it extends from the inner side toward the outer side in the radial direction. In other words, the combustion chamber 10 is disposed to protrude toward the filter chamber 60. Accordingly, the gas generator 300 of the present embodiment is configured such that the lower peripheral wall portion 31 of the lower container 3 is extended upward in accordance with the partition wall member 8A, and the joining portion between the upper container 2 and the lower container 3 is formed closer to the top plate portion 22 than the partition wall member 8A as compared with the first embodiment.

As described above, according to the present embodiment, since the combustion chamber 10 is formed to be larger than the gas generator 100 of the first embodiment, the filling amount of the gas generating agent 120 and the pressurized gas can be increased, and the performance of the gas generator 300 can be improved.

Fourth Embodiment

Figure 8:
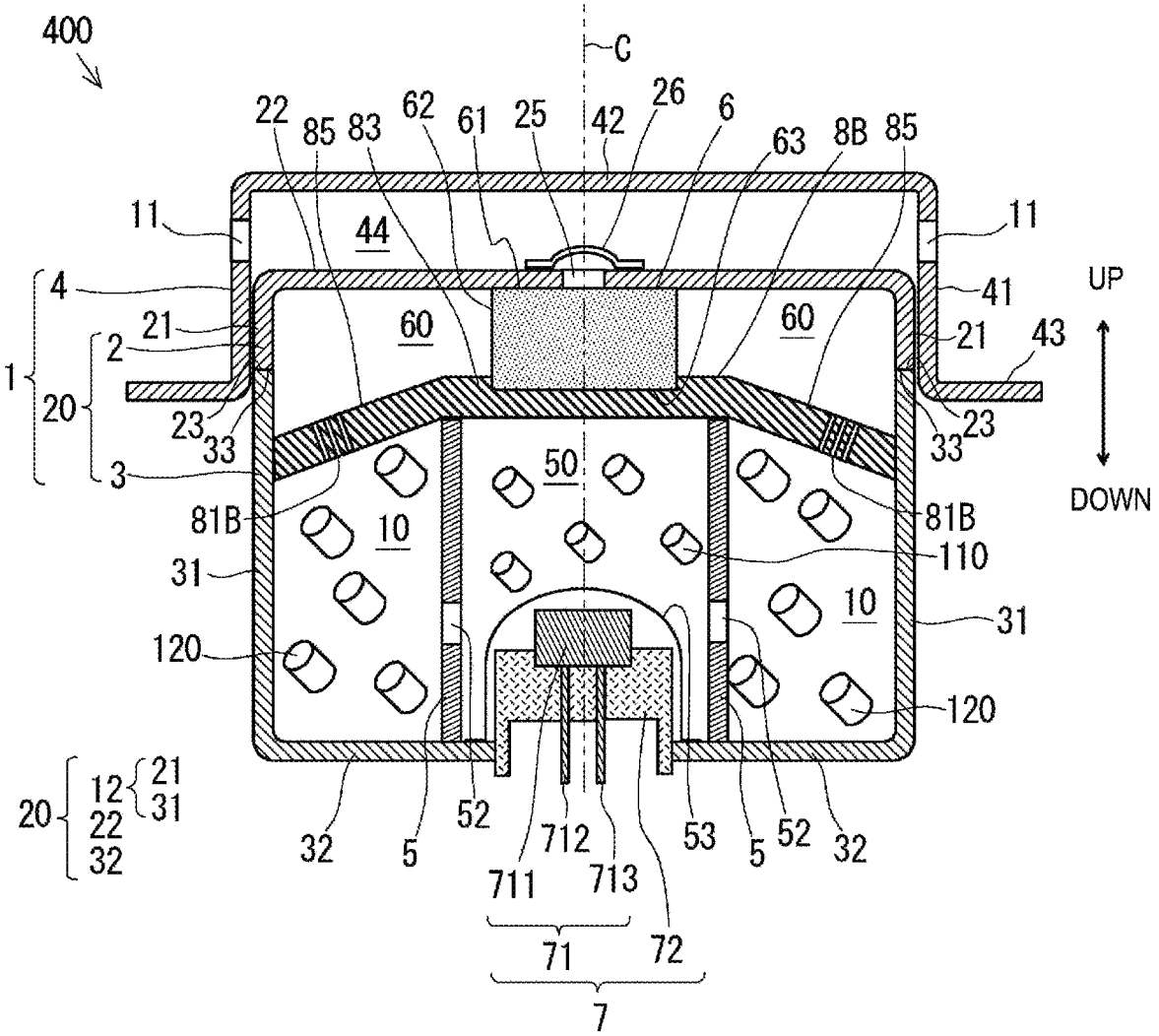
FIG. 8 is an axial cross-sectional view of a gas generator according to a fourth embodiment.

FIG. 8 is an axial cross-sectional view of a gas generator 400 according to a fourth embodiment. FIG. 8 illustrates a state of the gas generator 400 before activation. The present embodiment is different from the aforementioned third embodiment in terms of the configuration of a partition wall member 8B, but the other configurations are the same as those of the third embodiment. Accordingly, the same elements as those of the third embodiment are denoted by the same reference signs or the like and description thereof will not be repeated.

As illustrated in FIG. 8, the partition wall member 8B of the present embodiment is formed in a tapered shape such that an outer portion 85 not connected to the filter 6 is positioned closer to the lower side from the inner side to the outer side in the radial direction with respect to the center portion 83 connected to the filter 6. In addition, communication holes 81B of the partition wall member 8B are each formed to be positioned closer to the outer side (the peripheral wall portion 12 side) from the combustion chamber 10 toward the filter chamber 60. In other words, the communication hole 81B of the present embodiment is formed to be oriented such that the combustion gas is released toward the peripheral wall portion 12.

As described above, according to the present embodiment, the combustion gas generated in the combustion chamber 10 is released toward the peripheral wall portion 12, hits the peripheral wall portion 12, and thereafter flows into the filter 6. Therefore, large residues and highly adhesive residues in the combustion gas adhere to the peripheral wall portion 12 to be removed, and the use efficiency of the filter 6 can be improved.

Fifth Embodiment

Figure 9:
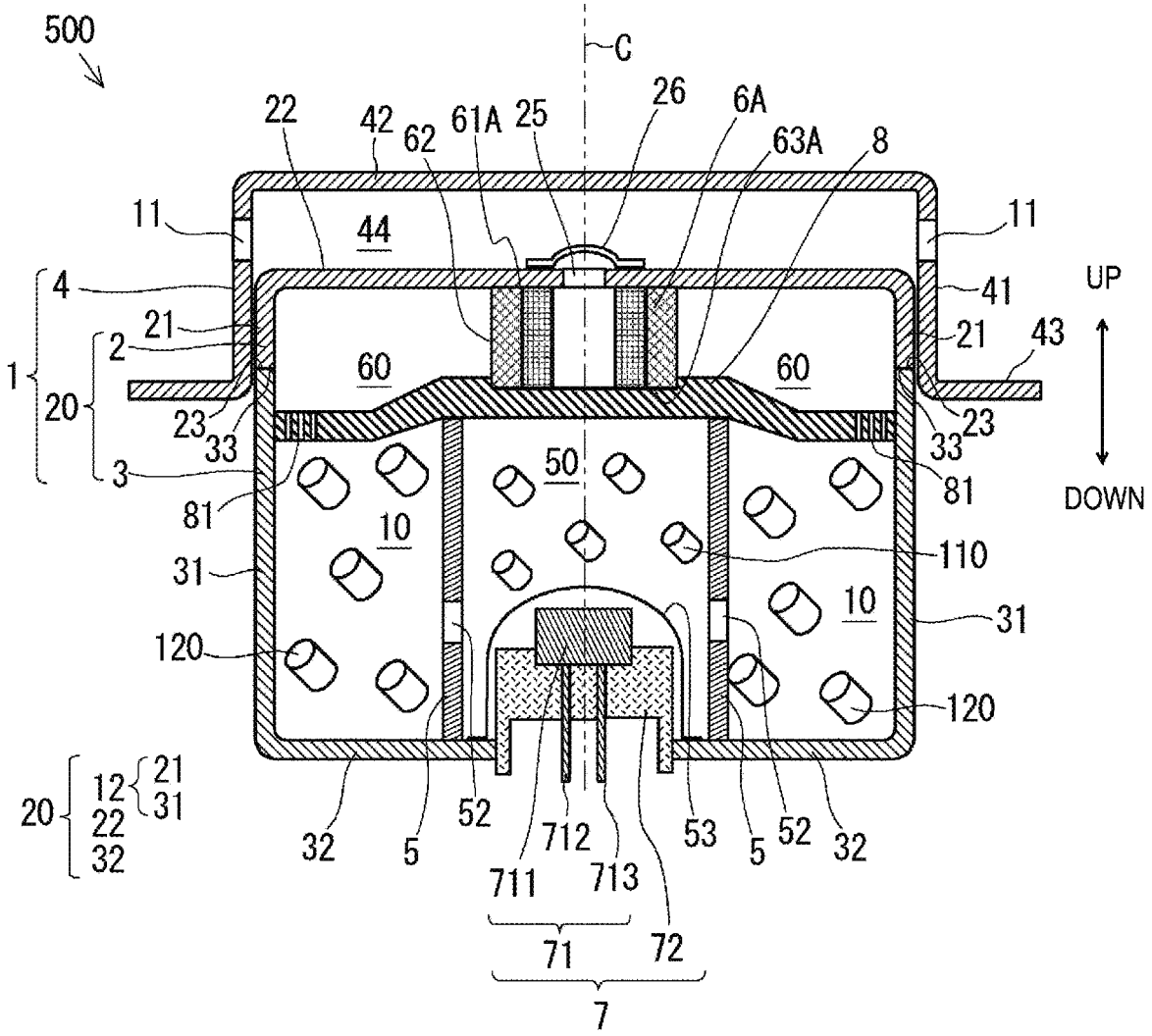
FIG. 9 is an axial cross-sectional view of a gas generator according to a fifth embodiment.
Figure 10:
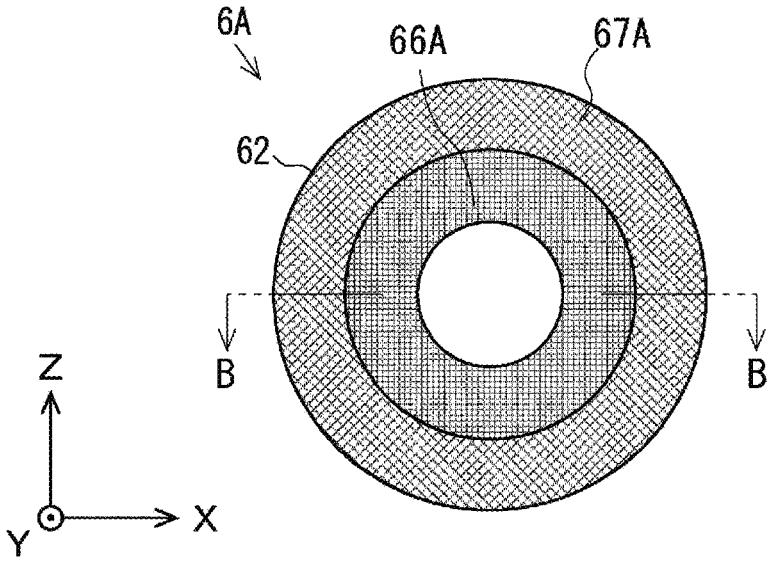
FIG. 10 is a plan view illustrating a layer structure of a filter according to the fifth embodiment.
Figure 11:
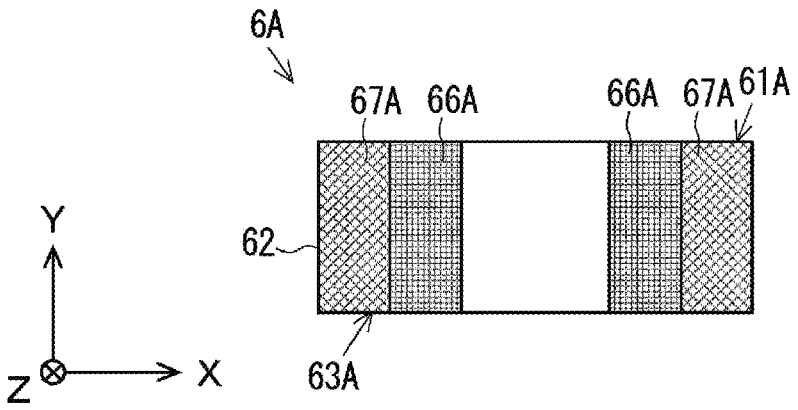
FIG. 11 is a cross-sectional view taken along line B-B in FIG. 10.

FIG. 9 is an axial cross-sectional view of a gas generator 500 according to a fifth embodiment, FIG. 10 is a plan view illustrating a layer structure of a filter 6A according to the fifth embodiment, and FIG. 11 is a cross-sectional view taken along line B-B of FIG. 10. FIG. 9 illustrates the state of the gas generator 500 before activation. The present embodiment is different from the aforementioned first embodiment in terms of the configuration of the filter 6A, but the other configurations are the same as those of the first embodiment. Accordingly, the same elements as those of the first embodiment are denoted by the same reference signs or the like and the description thereof will not be repeated.

As illustrated in FIG. 9, the filter 6A of the present embodiment is formed in a cylindrical shape. The filter 6A is configured such that one end surface (an upper surface) 61A in the axial direction is connected to the top plate portion 22 to surround the discharge port 25 and the other end surface (a lower surface) 63A is connected to the partition wall member 8. In other words, the filter 6A includes a through hole extending from the upper surface 61A to the lower surface 63A at the center in the radial direction, and the discharge port 25 is formed in a region facing the through hole. In addition, the filter 6A may include a plurality of layers in the radial direction, and the layers may be configured to have different specifications. For example, the filter 6A includes two layers of an inner portion 66A and an outer portion 67A, and the density of the outer portion 67A is lower than that of the inner portion 66A. Note that the number of layers is not limited to two, and may be set arbitrarily.

As described above, according to the present embodiment, the combustion gas generated in the combustion chamber 10 passes through the filter 6A from the outside to the inside thereof. Therefore, the use efficiency of the filter 6 can be improved. Note that in the present embodiment, the configurations other than the filter 6A are the same as those of the first embodiment, but are not limited thereto and may be the same as those of the second to fourth embodiments.

Sixth Embodiment

Figure 12:
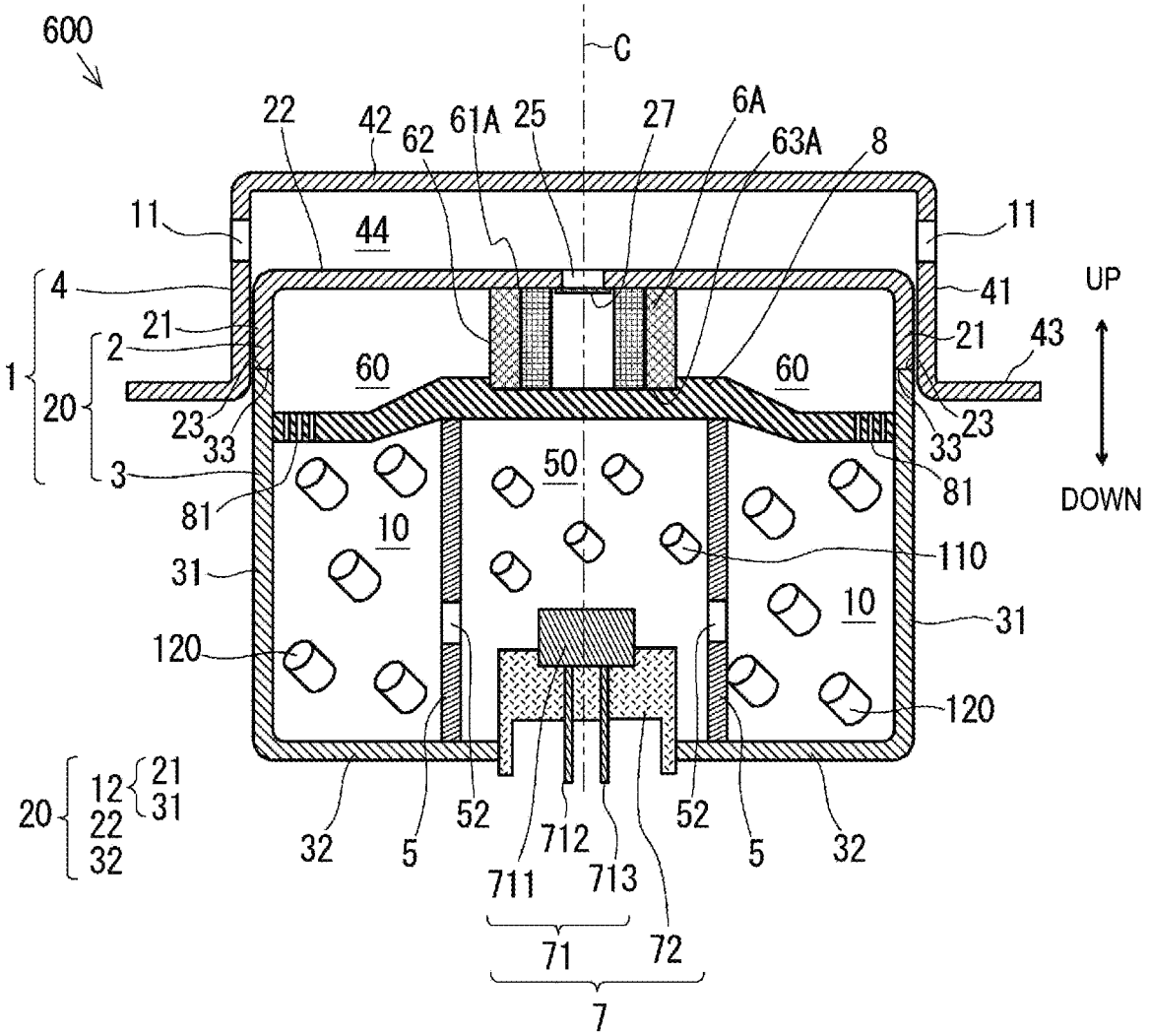
FIG. 12 is an axial cross-sectional view of a gas generator according to a sixth embodiment.

FIG. 12 is an axial cross-sectional view of a gas generator 600 according to a sixth embodiment. FIG. 12 illustrates a state of the gas generator 600 before activation. The present embodiment is different from the aforementioned fifth embodiment in terms of the configuration using a pyro-type in which pressurized gas is not used, but the other configurations are the same as those of the fifth embodiment. Accordingly, the same elements as those of the fifth embodiment are denoted by the same reference signs or the like and description thereof will not be repeated.

In the present embodiment, the container 20 is not filled with pressurized gas, and a lower end of the discharge port 25 is closed by a seal tape 27. In other words, the seal tape 27 is disposed in the internal space of the filter 6A such that the seal tape 27 and the filter 6A do not interfere with each other.

When the igniter 71 is activated and the transfer charge 110 and the gas generating agent 120 burn to generate combustion gas, the seal tape closing the communication hole 52 ruptures, and thus the combustion gas passes through the filter 6A, is discharged from the discharge port 25, and is released via the discharge side space 44 from the gas discharge port 11 to the outside of the housing 1.

As described above, according to the present embodiment, the combustion gas generated in the combustion chamber 10 passes through the filter 6A from the outside to the inside thereof. Therefore, the use efficiency of the filter 6 can be improved.

Seventh Embodiment

Figure 13:
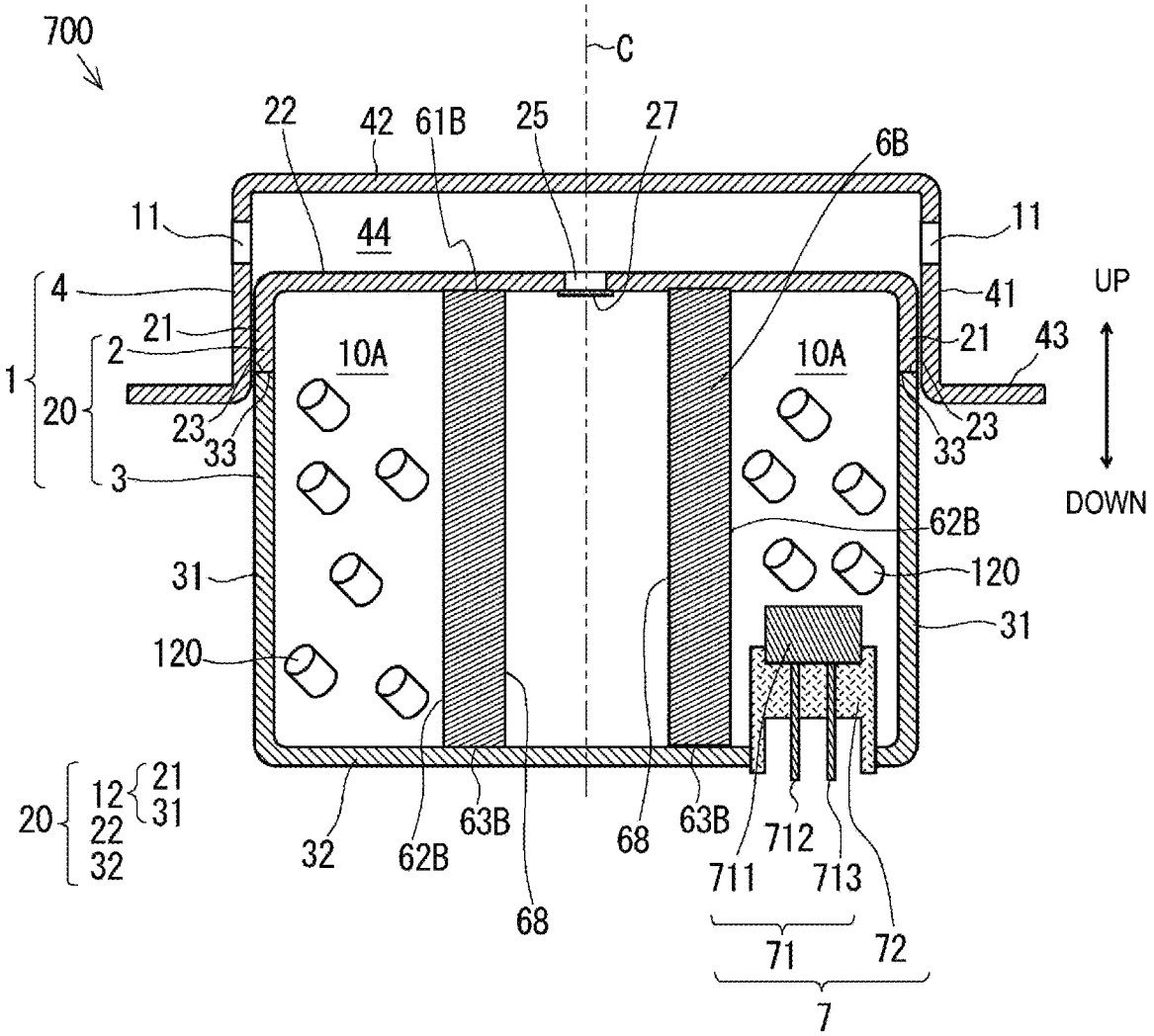
FIG. 13 is an axial cross-sectional view schematically illustrating an internal structure along the center axis of a gas generator according to a seventh embodiment.

FIG. 13 is an axial cross-sectional view schematically illustrating an internal structure along the center axis C of a gas generator 700 according to a seventh embodiment. Note that the same elements as those of the aforementioned first embodiment are denoted by the same reference signs or the like and the description thereof will not be repeated. In addition, the gas generator 700 of the seventh embodiment does not use pressurized gas.

As illustrated in FIG. 13, the gas generator 700 includes the ignition device 7, a filter 6B, the gas generating agent 120, and the housing 1 that accommodates these elements. The gas generator 700 of the present embodiment is configured as a so-called single-type gas generator including only one ignition device. The gas generator 700 is not limited thereto and may be configured to include a plurality of ignition devices.

The housing 1 is a member that accommodates the filter 6B, the ignition device 7, and the gas generating agent 120. The housing 1 is provided with the upper container 2 and the lower container 3 made of a metal each formed in a bottomed substantially tubular shape, and is formed in a short tubular shape in which both axial ends are closed by joining the upper container 2 and the lower container 3 in a state where opening ends face each other. The upper container 2 and the lower container 3 define a combustion chamber 10A, and constitute the container 20 in which the gas generating agent 120 and the like are disposed. The housing 1 also includes the outer shell member 4 externally fitted to the gas discharge side of the container 20, that is, the upper side in the present example.

The top plate portion 22 of the container 20 is provided with the discharge port 25 extending through the container 20 from the inside to the outside and configured to discharge the combustion gas generated in the container 20 to the outside.

The filter 6B having a tubular shape is disposed in the container 20 to divide the internal space of the container 20 into an inner space and an outer space, and the outer space serves as the combustion chamber 10A. The filter 6B includes a through hole formed from an upper surface 61B to a lower surface 63B at the center portion in the radial direction, and the discharge port 25 is formed to face a region (an internal space) formed by the through hole.

The ignition device 7 is disposed in the combustion chamber 10A in the lower container 3, and the gas generating agent 120 is made to fill the space around the ignition device 7.

The filter 6B is a tubular member formed of a metallic material. The upper surface 61B is in contact with the top plate portion 22 to surround the discharge port 25, the lower surface 63B is in contact with the bottom plate portion 32, and the filter 6B is sandwiched between the top plate portion 22 and the bottom plate portion 32.

The seal tape 27 is disposed at the center of the inner surface side of the top plate portion 22 to cover the discharge port 25, thereby closing the discharge port 25. In other words, the seal tape 27 is disposed in the internal space of the filter 6B such that the seal tape 27 and the filter 6B do not interfere with each other.

When the igniter 71 is activated, the ignition charge accommodated in the cup body 711 of the igniter 71 burns, and a flame, a high-temperature gas, and the like, which are combustion products, are released to the outside of the cup body 711. Thus, the gas generating agent 120 accommodated in the combustion chamber 10A burns, and a high-temperature and high-pressure combustion gas is generated. Then, the pressure in the container 20 increases, and the seal tape 27 closing the discharge port 25 ruptures, and thus the combustion gas is discharged from the discharge port 25 via the filter 6B. At this time, the combustion gas passes through the filter 6B, and thus the combustion gas is cooled, and combustion residues are trapped. The pressurized gas and the combustion gas discharged from the discharge port 25 to the discharge side space 44 hit the top plate portion 42 of the outer shell member 4, are deflected in the radial direction of the housing 1, and are released from the gas discharge port 11 to the outside of the housing 1. The pressurized gas and the combustion gas are released to the outside of the housing 1 and thereafter flow into an airbag (not illustrated). This causes the airbag to inflate, and thus a cushion is formed between an occupant and a rigid structure, and the occupant is protected from an impact.

In the gas generator 700 of the present embodiment, one end surface 61B of the filter 6B is connected to the inner wall surface of the top plate portion 22 to surround the discharge port 25, and an outer peripheral surface 62B is disposed to be in communication with the combustion chamber 10A. As a result, the combustion gas passes through the outer peripheral surface 62B of the filter 6B at the initial stage of inflow at which the contained residue amount therein is large, and passes toward an inner peripheral surface 68 of the filter 6B while being filtered with the contained residue amount decreasing. In other words, as the combustion gas flows toward the inner peripheral surface 68 from an inflow portion formed entirely in the circumferential direction of the outer peripheral surface 62B of the filter 6B, the contained residue amount decreases due to filtration, and the combustion gas temperature also decreases. In addition, the cross-sectional area in the filter radial direction with which the combustion gas comes into contact also gradually decreases. In other words, a contact area of the filter corresponding to the contained residue amount and the gas temperature is provided. Therefore, the use efficiency of the filter 6B can be improved, and the performance of the gas generator 700 can be improved.

In addition, in the gas generator 700 of the present embodiment, the upper surface 61B of the filter 6B is disposed in contact with the top plate portion 22, and the lower surface 63B of the filter 6B is disposed in contact with the bottom plate portion 32. As a result, the combustion gas is prevented from flowing between the upper surface 61B and the top plate portion 22 or between the lower surface 63B and the bottom plate portion 32, that is, a so-called "short path" is prevented, and the use efficiency of the filter 6B can be improved. Note that in the gas generators illustrated in FIGS. 9, 12, and 13, as long as a short path between the upper surfaces 61A, 61B of the filters and the top plate portion 22 is prevented, the through holes of the filters may not extend to the lower surfaces 63A, 63B, and a member may be interposed between the lower surfaces 63A, 63B and the partition wall member 8 or the bottom plate portion 32 such that the filters are disposed separated from the partition wall member 8 or the bottom plate portion 32.

Other

Suitable embodiments according to the present disclosure have been described above, but each embodiment disclosed in the present specification can be combined with each of features disclosed in the present specification.

REFERENCE SIGNS LIST

1 Housing
10 Combustion chamber
100 to 700 Gas generator

10A Combustion chamber
11 Gas discharge port
110 Transfer charge
12 Peripheral wall portion
120 Gas generating agent
2 Upper container
20 Container
21 Upper peripheral wall portion
22 Top plate portion
221 Lower surface
222 Groove portion
22A Top plate portion
23 Joining portion
25 Discharge port
26 Rupturable plate
27 Seal tape
3 Lower container
31 Lower peripheral wall portion
32 Bottom plate portion
33 Joining portion
4 Outer shell member
41 Peripheral wall portion
42 Top plate portion
43 Flange portion
44 Discharge side space
5 Inner tubular member
50 Fire transfer chamber
52 Communication hole
6, 6A, 6B Filter
60 Filter chamber
7 Ignition device
8 Partition wall member
81, 81B Communication hole
82 Recessed portion

The invention claimed is:

1. A gas generator, comprising:
a housing;
an ignition unit disposed in the housing;
a gas generating agent that is accommodated in a combustion chamber in the housing and that generates a combustion gas upon operation of the ignition unit;
a discharge port provided in the housing and configured to discharge the combustion gas from the housing; and
a filter disposed so as to oppose the discharge port and extending in an axial direction of the housing, the filter including a first axial end surface and a second axial end surface opposite to the first axial end surface; and,
a partition wall member partitioning a space inside the housing into the combustion chamber accommodating therein the gas generating agent and a filter chamber accommodating therein the filter, the partition wall member including a communication hole allowing the combustion chamber and the filter chamber to be in communication with each other,
wherein,
at least an outer peripheral portion on the first axial end surface of the filter is in contact with an inner wall surface of the housing to surround the discharge port,
a portion that is at least a part of an outer peripheral surface of the filter around an axis of the filter and that extends over the entire circumference is an inflow portion of the combustion gas,
the inflow portion is disposed to be in communication with the combustion chamber, and
the second axial end surface of the filter is in contact with the partition wall member.

2. The gas generator according to claim 1,
wherein the housing includes a tubular peripheral wall portion extending along the axial direction, a first wall portion closing one end of the tubular peripheral wall portion, and a second wall portion closing the other end of the tubular peripheral wall portion, and
the discharge port is formed in the first wall portion in a direction in which the combustion gas is released in a direction orthogonal to the first wall portion.

3. The gas generator according to claim 1,
wherein the housing includes a tubular peripheral wall portion extending along the axial direction, a first wall portion in which the discharge port is formed and which closes one end of the tubular peripheral wall portion, and a second wall portion closing the other end of the tubular peripheral wall portion,
a groove portion is disposed in an inner surface of the first wall portion along a circumferential direction, and
the communication hole is disposed at a position in which the combustion gas is released toward the groove portion.

4. The gas generator according to claim 1,
wherein the housing includes a tubular peripheral wall portion extending along the axial direction, a first wall portion in which the discharge port is formed and which closes one end of the tubular peripheral wall portion, and a second wall portion closing the other end of the tubular peripheral wall portion, and
the partition wall member is formed such that a portion not in contact with the filter protrudes toward the first wall portion of the housing with respect to a portion in contact with the filter.

5. The gas generator according to claim 1,
wherein the housing includes a peripheral wall portion having a tubular shape, and
the communication hole is formed in a direction in which the combustion gas is released toward the peripheral wall portion.

6. The gas generator according to claim 1,
wherein the filter is cylindrical in shape.

7. The gas generator according to claim 1,
wherein the housing includes a tubular peripheral wall portion extending along the axial direction, a first wall portion closing one end of the tubular peripheral wall portion, and a second wall portion closing the other end of the tubular peripheral wall portion, and
one end surface of the filter in the axial direction is in contact with the first wall portion, and the other end surface of the filter is in contact with the partition wall member.

8. A gas generator, comprising:
a housing including therein a first chamber and a second chamber;
a discharge port provided in the housing and configured to discharge a gas from the housing; and
a filter provided within the second chamber so as to cover the discharge port such that a first end surface thereof in an axial direction is attached to an inner wall surface of the housing, an outer peripheral surface thereof is in communication with the first chamber; and
a partition wall partitioning the housing into the first chamber and the second chamber, the partition wall being provided with a communication hole configured to allow the first chamber and the second chamber to be in communication with each other,
wherein a second end surface opposite to the first end surface of the filter is in contact with the partition wall.

9. The gas generator according to claim 8, wherein the housing includes a tubular peripheral wall extending along the axial direction, a first wall closing one end of the tubular peripheral wall, and a second wall closing the other end of the tubular peripheral wall, and the discharge port is formed in the first wall portion in a direction in which the gas is released in a direction orthogonal to the first wall.

10. The gas generator according to claim 8, wherein the housing includes a tubular peripheral wall extending along the axial direction, a first wall in which the discharge port is formed and which closes one end of the tubular peripheral wall, and a second wall closing the other end of the tubular peripheral wall, a groove is disposed in an inner surface of the first wall along a circumferential direction, and the communication hole is disposed at a position in which the gas is released toward the groove portion.

11. The gas generator according to claim 8, wherein the housing includes a tubular peripheral wall extending along the axial direction, a first wall in which the discharge port is formed and which closes one end of the tubular peripheral wall, and a second wall which closes the other end of the tubular peripheral wall, and the partition wall is formed such that a portion not in contact with the filter protrudes toward the first wall portion of the housing with respect to a portion in contact with the filter.

12. The gas generator according to claim 8, wherein the housing includes a peripheral wall having a tubular shape, and the communication hole is formed in a direction in which the gas is released toward the peripheral wall portion.

13. The gas generator according to claim 8, wherein the filter is cylindrical in shape.

14. The gas generator according to claim 8, wherein the housing includes a tubular peripheral wall extending along the axial direction, a first wall closing one end of the tubular peripheral wall, and a second wall closing the other end of the tubular peripheral wall, and the first end surface of the filter is attached to the first wall, and the second end surface of the filter is attached to the second wall.

* * * * *